US006916775B1

(12) United States Patent
Gordon

(10) Patent No.: US 6,916,775 B1
(45) Date of Patent: Jul. 12, 2005

(54) FABRIC ENHANCEMENT COMPOSITIONS HAVING IMPROVED COLOR FIDELITY

(75) Inventor: Neil James Gordon, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/980,796

(22) PCT Filed: Jun. 27, 2000

(86) PCT No.: PCT/US00/17649

§ 371 (c)(1),
(2), (4) Date: Dec. 3, 2001

(87) PCT Pub. No.: WO01/00767

PCT Pub. Date: Jan. 4, 2001

Related U.S. Application Data

(60) Provisional application No. 60/141,557, filed on Jun. 29, 1999.

(51) Int. Cl.[7] ..... C11D 1/83; C11D 3/30; C11D 3/32; C11D 3/37

(52) U.S. Cl. ..... 510/320; 510/321; 510/336; 510/337; 510/500; 510/501

(58) Field of Search ..... 510/302, 303, 510/320, 321, 336, 337, 499, 500, 501; 8/137

(56) References Cited

U.S. PATENT DOCUMENTS

| | | | | | |
|---|---|---|---|---|---|
| 3,320,215 | A | | 5/1967 | Conte et al. | |
| 3,663,444 | A | | 5/1972 | Schmadel | |
| 4,144,123 | A | | 3/1979 | Scharf et al. | |
| 4,597,898 | A | | 7/1986 | Vander Meer | |
| 4,634,544 | A | | 1/1987 | Weber et al. | |
| 6,025,322 | A | * | 2/2000 | Boeckh et al. | 510/516 |
| 6,083,898 | A | * | 7/2000 | Meixner et al. | 510/499 |
| 6,111,056 | A | | 8/2000 | Hildebrandt et al. | |
| 6,376,446 | B1 | | 4/2002 | Smadi et al. | |
| 6,465,415 | B2 | * | 10/2002 | Boeckh et al. | 510/475 |

FOREIGN PATENT DOCUMENTS

| | | | |
|---|---|---|---|
| WO | WO/9817762 | * | 4/1998 |
| WO | WO 98/17764 | * | 4/1998 |
| WO | WO 98/29527 A1 | | 7/1998 |
| WO | WO 98/29530 A2 | | 7/1998 |
| WO | WO 99/02632 A1 | | 1/1999 |
| WO | WO 99/14300 A1 | | 3/1999 |
| WO | WO 00/22077 A1 | | 4/2000 |
| WO | WO 00/29527 A2 | | 5/2000 |
| WO | WO 00/49122 A1 | | 8/2000 |

* cited by examiner

*Primary Examiner*—Gregory R. Del Cotto
(74) *Attorney, Agent, or Firm*—Jason J. Camp; David V. Upite

(57) ABSTRACT

Laundry and laundry detergent compositions comprise a fabric enhancement system which comprises one or more polyamines and a transition metal-containing dye protection system which comprises an oligomer formed from the reaction of an imidazole and a crosslinking agent, preferably epichlorohydrin. Said compositions provide fabric integrity benefits but mitigate the coor fidelity problems which may be caused by the use of certain polyamines.

20 Claims, No Drawings

FABRIC ENHANCEMENT COMPOSITIONS HAVING IMPROVED COLOR FIDELITY

This application claims the benefit of provisional application No. 60/141,557, filed Jun. 29, 1999.

FIELD OF THE INVENTION

The present invention relates to fabric care and laundry detergent compositions which comprise a fabric enhancement system in combination with a transition metal-comprising dye protection system, which acts to mitigate the loss of fabric color, providing a laundry composition which provides enhanced fabric appearance benefits.

BACKGROUND OF THE INVENTION

Formulators of fabric care and laundry detergent compositions include various ingredients, inter alia surfactants, cationic softening actives, anti-static agents, dye transfer inhibitors, and bleach-damage mitigating agents, for the purpose of improving cleaning, fabric appearance, fabric feel, fabric color and to extend the duration of fabric life. Ingredients which are added to these compositions must not only provide a benefit, but must be compatible with a variety of product forms, i.e. high density granules, liquid dispersions, isotropic liquids including clear, colorless/translucent liquids which may include principal solvents inter alia 1,2-hexanediol, 2,2,4-trimethyl-1,3-pentanediol (TMPD).

Many adjunct ingredients which provide fabric enhancement benefits are highly fabric substantive and, therefore, once deposited on the fabric surface remain with the fabric thereby providing the intended benefit until chemically altered or until displaced by a more fabric substantive material. High molecular weight modified polyalkyleneimines have been used in granular and liquid detergent compositions as well as rinse-added fabric conditioning compositions to mitigate fabric damage. These highly fabric substantive ingredients can be deposited onto fabric at various optimal times, for example, in the alkaline laundry wash liquor or the near neutral pH environment of the laundry rinse cycle. Once deposited they serve a variety of purposes depending upon the absolute structure of the polyalkyleneamine or polyalkyleneimine and whether the polymeric amine is modified (for example, ethoxylated).

Color integrity is an important aspect of fabric enhancement. When certain polyamines are deposited onto fabric they enhance color fidelity via various mechanisms. Other polyamines intercept peroxygen bleaching agents at the fabric surface. However, many polyamines which provide fabric benefits also have a propensity to chelate heavy metals, inter alia, copper, which are components of transition metal-comprising fabric dyes. The chelation, and hence the extraction of, these heavy metals is ruinous to the fidelity of fabric color.

Therefore, there is a long felt need to provide colored fabric with protection against the pejorative effects of certain laundry-added fabric integrity materials, inter alia, polyamines which provide fabric wear protection and fabric lubricity benefits. In addition, there is a need for materials which will be highly water soluble or water dispersible, while exhibiting a high degree of fabric substantivity. And there is also a need for a material which will provide a high level of fabric dye protection on an efficient per unit weight basis.

SUMMARY OF THE INVENTION

The present invention meets the aforementioned needs in that it has been surprisingly discovered that oligomers which are formed from the reaction of imidazoles and a crosslinking agent, preferably an epihalohydrin, provide transition metal-comprising dye protection benefits. It has now been surprisingly discovered that the combination of a dye protection system which comprises the imidazole derived oligomers is combined with a polyamine based fabric enhancement system, the pejorative effects of heavy metal ion chelation by the fabric enhancement system is abated.

The heavy metal-comprising dye protection systems of the present invention are suitable for use in high and low density granular, heavy duty and light duty liquids, as well as laundry bar detergent compositions to provide fabric appearance benefits inter alia mitigation of fabric damage, prevention of fabric mechanical damage, as well as, the protection of color fidelity.

A first aspect of the present invention which relates to fabric care compositions comprising:

a) from about 0.01% by weight, of a fabric enhancement system, said fabric enhancement system comprising one or more modified polyamine compounds, said modified polyamine compounds are selected from:
   i) $(PA)_w(T)_x$;
   ii) $(PA)_w(L)_z$;
   iii) $[(PA)_w(T)_x]_y[L]_z$; and
   iv) mixtures thereof;
   wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

b) from about 0.01% by weight, of a transition metal-comprising dye protection system, said dye protection system comprising one or more oligomers formed from the reaction of:
   i) 1 part by weight of an epihalohydrin; and
   ii) from 0.5 to 2 parts by weight of a substituted or unsubstituted imidazole; and c) the balance carriers and adjunct ingredients.

The present invention further relates to laundry detergent compositions which comprise:

a) from about 0.01% by weight, of a detersive surfactant selected from the group consisting of anionic, cationic, nonionic, zwitterionic, ampholytic surfactants, and mixtures thereof;

b) from about 0.01% by weight, of a fabric enhancement system, said fabric enhancement system comprising one or more modified polyamine compounds, said modified polyamine compounds are selected from:
   i) $(PA)_w(T)_x$;
   ii) $(PA)_w(L)_z$;
   iii) $[(PA)_w(T)_x]_y[L]_z$; and
   iv) mixtures thereof;
   wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

c) from about 0.01% by weight, of a transition metal-comprising dye protection system, said dye protection system comprising one or more oligomers formed from the reaction of:
   i) 1 part by weight of an epihalohydrin; and
   ii) from 0.5 to 2 parts by weight of a substituted or unsubstituted imidazole; and d) the balance carriers and adjunct ingredients, said adjunct ingredients are selected from the group consisting of builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

These and other objects, features, and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to laundry detergent compositions which provide fabric care benefits, said benefits provided by the combination of a fabric enhancement system and a transition metal-comprising dye protection system. The laundry compositions comprise from about 0.01%, preferably from about 0.1%, more preferably from 0.25%, most preferably from about 0.5% to about 20%, preferably to about 10%, more preferably to about 5% by weight, of a fabric enhancement system. Said fabric enhancement system is comprised of one or more modified polyamine compounds. The laundry compositions also comprise from about 0.01%, preferably from about 0.1%, more preferably from 0.25%, most preferably from about 0.5% to about 20%, preferably to about 10%, more preferably to about 5% by weight, of a transition metal-comprising dye protection system. Said dye protection system is comprised of one or more oligomeric compounds as described herein below. The enhanced fabric care compositions may take any form, for example, solids (i.e., powders, granules, extrudates), gels, thixotropic liquids, liquids (i.e., dispersions, isotropic solutions), preferably the rinse-added fabric conditioning compositions take the form of liquid dispersions or isotropic liquids.

For the purposes of the present invention the terms "fabric enhancement" and "fabric care" are used interchangeable throughout the present specification and stand equally well for one another. Fabric enhancement/fabric care is achieved when the properties inter alia color, fiber integrity of the garment are conserved (that is no further damage is done during the laundry process) or the damaging process is reversed and the fabric appears more like its original form.

Fabric Enhancement System

The fabric enhancement system of the present invention is comprised of one or more modified polyamines according to the present invention. The modified polyamines of the present invention which comprise the fabric enhancement system may be formulated as an admixture wherein a proportional amount of two or more compounds are combined to make up the fabric enhancement system. Alternatively, the formulator may adjust the reaction conditions which form the modified polyamines of the present invention in order to create an admixture of suitable ingredients inter alia an admixture of polyamine fragments and/or partially crosslinked modified polyamines. Whether a formulated admixture or a product by process is used, or a mixture of both, the compounds which comprise the fabric enhancement compositions of the present invention have the formula:

i) $(PA)_w(T)_x$;
ii) $(PA)_w(L)_z$;
iii) $[(PA)_w(T)_x]_y[L]_z$;

wherein PA is a grafted or non-grafted, modified or unmodified polyamine backbone unit, T is an amide-forming polycarboxylic acid crosslinking unit, and L is a non-amide forming crosslinking unit. For compounds of type (i) and (iii) the relative amounts of PA units and T units which are present are such that the molar ratio of PA units to T units is from 0.8:1 to 1.5:1. For compounds of type (ii) the relative amounts of PA units and L units which are present are such that the $(PA)_w(L)_z$ comprises from about 0.05, preferably from about 0.3 to 2 parts by weight of said L units. Therefore, 1 part of a grafted or non-grafted, modified or unmodified polyamine backbone unit may be combined with from about 0.05, preferably from about 0.3 parts by weight of an L unit to about 2 parts by weight of an L unit to form a suitable modified polyamine compound. Likewise, for compounds of type (iii), crosslinked polyamines having the formula $(PA)_w(T)_x$ may be combined with from about 0.05, preferably from about 0.3 parts by weight of an L unit to about 2 parts by weight of an L unit to form a suitable modified polyamine compound having the formula $[(PA)_w(T)_x]_y[L]_z$.

Polyamine Backbone (PA Units)

The modified polyamine compounds of the present invention comprise a Polyamine Backbone, PA unit, which can be optionally, but preferably grafted. The following are non-limiting examples of suitable PA units according to the present invention.

Polyalkyleneimine

A preferred PA unit according to the present invention are polyalkyleneimines and polyalkyleneamines having the general formula:

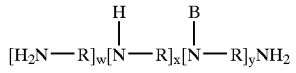

wherein R is $C_2$–$C_{12}$ linear alkylene, $C_3$–$C_{12}$ branched alkylene, and mixtures thereof; B representing a continuation of the chain structure by branching. The indices w, x, and y have various values depending upon such factors as molecular weight and relative degree of branching. The polyalkyleneimines and polyalkyleneamines which comprise PA units of the present invention are divided into three categories based upon relative molecular weight. The terms polyalkyleneimine and polyalkyleneamine are used interchangeably throughout the present specification and are taken to mean polyamines having the general formula indicated above regardless of method of preparation.

Low Molecular Weight Polyalkyleneimines

For low molecular weight polyalkyleneimines having the formula:

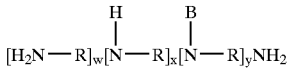

R is $C_2$–$C_{12}$ linear alkylene, $C_3$–$C_{12}$ branched alkylene, and mixtures thereof; preferably R is ethylene, 1,3-propylene, and 1,6-hexylene, more preferred is ethylene. The indices w, x, and y are such that the molecular weight of said polyamines does not exceed about 600 daltons. For example, for an entirely linear polyethyleneimine having a molecular weight of about 600 daltons, the index w=1, x=13, and y=0. For an entirely branched polyethyleneimine having a molecular weight of approximately 600 daltons, w=8, x=0 and y=7. (This combination of indices results in a material having an average molecular weight of about 646 daltons, which, for the purposes of the present invention is a low molecular weight polyalkyleneimine.) The index w typically has the value of y+1. The simplest of the low molecular weight polyamines of this type is ethylene diamine which may be present up to about 10% by weight of the PA unit mixture. Non-limiting examples of low molecular weight polyalkyleneimine PA units include diethylene triamine, triethylene tetramine, tetraethylene pentamine, dipropylene triamine, tripropylene tetramine, and dihexamethylene triamine. PA units may be used as crude products or mixtures, and if desired by the formulator, these PA units may be used in the presence of small amounts of diamines as described herein above, wherein the amount of diamines, inter alia, ethylene diamine, hexamethylene diamine may be present up to about 10% by weight, of the PA unit mixture.

Medium Range Molecular Weight Polyalkyleneimines

For medium range molecular weight polyalkyleneimines having the formula:

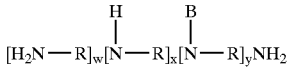

R is $C_2$–$C_4$ linear alkylene, $C_3$–$C_4$ branched alkylene, and mixtures thereof; preferably R is ethylene, 1,3-propylene, and mixtures thereof, more preferred is ethylene wherein said polyamines are polyethyleneimines (PEI's). The indices w, x, and y are such that the molecular weight of said polyamines is from about 600 daltons to about 50,000 daltons. The indices w, x, and y will indicate not only the molecular weight of the polyalkyleneimines but also the degree of branching present in the PA unit backbone.

High Molecular Weight Polyalkyleneimines

For high molecular weight polyalkyleneimines having the formula:

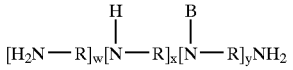

R is $C_2$–$C_3$ linear alkylene, preferably R is ethylene. The indices w, x, and y arc such that the molecular weight of said polyamines is from about 50,000 daltons to about 30,000,000 (30 million) daltons, preferably to about 1,000,000 (1 million) daltons. The indices w, x, and y will indicate not only the molecular weight of the polyalkyleneimines but also the degree of branching present in the PA unit backbone.

Co-polymeric Polyamines

Another example of a preferred PA unit according to the present invention are the polyvinyl amine homo-polymers or co-polymers having the formula:

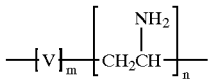

wherein V is a co-monomer, non-limiting examples of which include vinyl amides, vinyl pyrrolidone, vinyl imidazole, vinyl esters, vinyl alcohols, and mixtures thereof, all of which can be taken together or in combination with polyvinyl amine to form suitable co-polymerization products suitable for use in the fabric enhancement systems of the present invention. The indices m and n are such that the copolymers comprise at least 10%, more preferably at least about 30% of units derived from vinyl amine and wherein further the molecular weight of said copolymers if from about 500 daltons, preferably from about 5,000 daltons to about 50,000 daltons, preferably to about 20,000 daltons.

Polyamine Backbone Modifications

Optionally but preferably the PA units of the present invention are modified either before or after reaction with a T unit or L unit crosslinking agent. The two preferred types of modifications are grafting and capping.

Preferably the PA units of the present invention are grafted, that is the PA unit is further reacted with a reagent which elongates said PA unit chain, preferably by reaction of the nitrogens of the PA backbone unit with one or more equivalents of aziridine (ethyleneimine), caprolactam, and mixtures thereof. Grafting units, in contrast to the "capping" units described herein below, can further react on themselves to provide PA unit chain propagation. An example of a preferred grafted PA unit of the present invention has the formula:

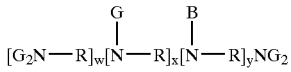

wherein R, B, w, x, and y are the same as defined herein above and G is hydrogen or an extension of the PA unit backbone by grafting. Non-limiting examples of preferred grafting agents are aziridine (ethyleneimine), caprolactam, and mixtures thereof. A preferred grafting agent is aziridine wherein the backbone is extended by units having the formula:

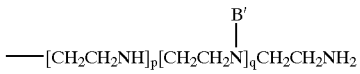

wherein B' is a continuation by branching wherein the graft does not exceed about 8 units, preferably $—CH_2CH_2NH_2$ and the value of the indices p+q have the value from 0, preferably from about 1, more preferably from about 2 to about 7, preferably to about 5. Another preferred grafting unit is caprolactam.

The PA units of the present invention can be grafted prior to or after crosslinking with one or more T units described herein below, preferably the grafting is accomplished after crosslinking with said T unit. This allows the formulator to take advantage of the differential reactivity between the primary and secondary amino units of the PA unit backbone thereby allowing the formulator to controllably link said PA units and to also control the amount of subsequent branching which results from the grafting step.

Another optional but preferred PA unit modification is the presence of "capping" units. For example, a PA unit is reacted with an amount of a monocarboxylic acid, non-limiting examples of which are $C_1$–$C_{22}$ linear or branched alkyl, preferably $C_{10}$–$C_{18}$ linear alkyl inter alia lauric acid, myristic acid. The amount of capping unit which is reacted with the PA unit is an amount which is sufficient to achieve the desired properties of the formula. However, the amount of capping unit used is not sufficient to abate any further crosslinking or grafting which the formulator may choose to perform.

Crosslinking Units

Amide-forming T Crosslinking Units

T crosslinking units are preferably carbonyl comprising polyamido forming units. The T units are taken together with PA units to form crosslinked modified polyamine compounds having the formula $(PA)_w(T)_x$ or $[(PA)_w(T)_x]_y[L]_z$.

A preferred embodiment of the present invention includes crosslinked PA units wherein a T unit provides crosslinking between two or more PA units to form a $(PA)_w(T)_x$ polyamido crosslinked section. A preferred crosslinking T unit has the general formula:

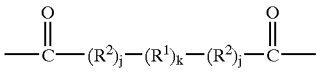

wherein $R^1$ is methylene, phenylene, and mixtures thereof; preferably methylene. The index k has the value from 2 to about 8, preferably to about 4. Preferred values of k are 2, 3, and 4. $R^2$ is—NH— thereby forming a urethane amide linkage when said $R^2$ comprising T units react with the backbone nitrogens of the PA units. The value of the index j is independently 0 or 1. The presence of $R^2$ units can result, for example, from the use of diisocyanates as crosslinking agents. Non-limiting examples of dibasic acids which are used as a source for T units in the above formula include succinic acid, maleic acid, adipic acid, glutaric acid, suberic acid, sebacic acid, and terepbthalic acid. However, the formulator is not limited to crosslinking T units deriving from dibasic acids, for example, tribasic crosslinking T units, inter alia, citrate, may be used to link the PA units of the present invention.

Examples of $(PA)_w(T)_x$ compounds according to the present invention are obtained by condensation of dicarboxylic acids inter alia succinic acid, maleic acid, adipic acid, terephthalic acid, with polyalkylene polyamines inter alia diethylenetriamine, triethylenetetramine, dipropylenetriamine, tripropylenetetramine wherein the ratio of the dicarboxylic acid to polyalkyleneamine is from 1:0.8 to 1:1.5 moles, preferably a ratio of from 1:0.9 to 1:1.2 moles wherein the resulting crosslinked material has a viscosity in a 50% by weight, aqueous solution of more than 100 centipoise at 25° C.

Non-amide Forming L Crosslinking Units

Another preferred embodiment of the polyamines of the present invention are $(PA)_w(T)_x$ units which are further crosslinked by L units to form polyamido amines having the formula $[(PA)_w(T)_x]_y[L]_z$ or are reacted with PA units to form non-amide polyamines having the formula $(PA)_w(L)_z$.

The L units of the present invention are any unit which suitably crosslinks PA units or $(PA)_w(T)_x$ units. Preferred L linking units comprise units which are derived from the use of epihalohydrins, preferably epichlorohydrin, as a crosslinking agent. The epihalohydrins can be used directly with the PA units or suitably combined with other crosslinking adjuncts non-limiting examples of which include alkyleneglycols, and polyalkylene polyglycols inter alia ethylene glycol, diethylene glycol, polyethylene glycol, propylene glycol, dipropylene glycol, polypropylene glycol, butylene glycol, hexanediol-1,6-glycerol, oligoglycerol, pentaerythrites, polyols which are obtained by the reduction of carbohydrates (sorbitol, mannitol), monosaccharides, disaccharides, oligosaccharides, polysaccharides, polyvinyl alcohols, and mixtures thereof.

For example, a suitable L unit is a dodecylene unit having the formula:

$$—(CH_2)_{12}—$$

wherein an equivalent of 1,12-dichlorododecane is reacted, for example, with a suitable amount of a PA unit to produce a polyamine which is crosslinked via dodecylene units. For the purposes of the present invention, L crosslinking units which comprise only carbon and hydrogen are considered to be "hydrocarbyl" L units. Preferred hydrocarbyl units are polyalkylene units have the formula:

$$—(C_2)_n—$$

wherein n is from 1 to about 50.

Hydrocarbyl L units may be derived from hydrocarbons having two units which are capable of reacting with the nitrogen of the PA units. Non-limiting examples of precursors which result in the formation of hydrocarbyl L units include 1,6-dibromohexane, 1,8-ditosyloctane, and 1,14-dichlorotetradecane.

Further examples of preferred non-amide forming crosslinking L units are the units which derive from crosslinking units wherein epihalohydrin is used as the connecting unit. For example, 1,12-dihydroxydodecane is reacted with epichlorohydrin to form the bis-epoxide non-amide forming L unit precursor having the formula:

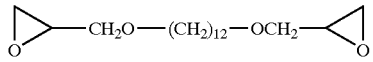

which when reacted with one or more PA units or $(PA)_w(T)_x$ units results in an L crosslinking unit having the formula:

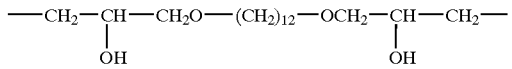

however, it is not necessary to pre-form and isolate the bis-epoxide, instead the crosslinking unit precursor may be formed in situ by reaction of 1,12-dihydroxydodecane or other suitable precursor unit with epihalohydrin in the presence of grafted or ungrafted PA units or $(PA)_w(T)_x$ units.

Other crosslinking L units which utilize one or more epihalohydrin connecting units include polyalkyleneoxy L units having the formula:

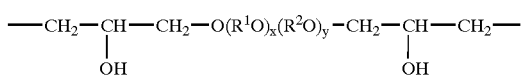

wherein $R^1$ is ethylene, $R^2$ is 1,2-propylene, x is from 0 to 100 and y is from 0 to 100. Another preferred unit which can comprise an L unit and which can be suitably combined with epihalohydrin connecting units include polyhydroxy units having the formula:

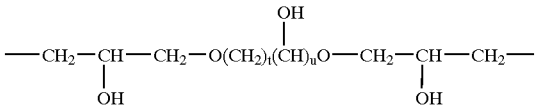

wherein the index t is from at least 2 to about 20 and the index u is from 1 to about 6. The formulator may also combine units to form hybrid L crosslinking units, for example, units having the formula:

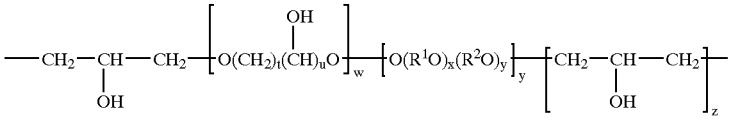

wherein the indexes w and y are each independently from 1 to 50, z is units are present in a sufficient to suitably connect the polyhydroxy units and the polyalkyleneoxy units into the backbone without the formation of ether linkages.

The following is an example of an L linking group which comprises both a polyalkyleneoxy and a polyhydroxy unit.

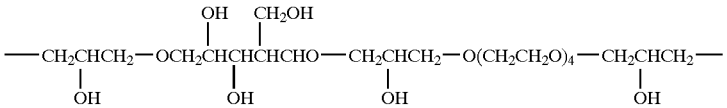

A further example of a preferred crosslinking L units are units which comprises at least two aziridine groups as connecting groups, for example an L unit having the formula:

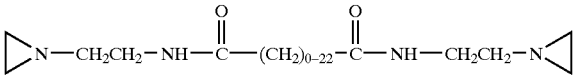

which can be used to link two $(PA)_w$ units, two $(PA)_w(T)_x$ units, or mixtures thereof.

The polyamines of the present invention may have varying final compositions, for example, $(PA)_w(T)_x$, $[(PA)_w(T)_x]_y[L]_z$, $[(PA)]_w[L]_z$, and mixtures thereof, wherein each PA unit may be grafted or ungrafted. The indices w and x have values such that the ratio of w to x is from 0.8:1 to 1.5:1; y and z have values such that said polyamido compound comprises from about 0.3 to 2 parts by weight of said L unit. In the cases wherein no crosslinking takes place the indices w and y will be equal to 1 and x and z will be equal to 0. In the case wherein no crosslinking occurs using L units, the index y is equal to 1 and z is equal to 0. In the case wherein no crosslinking occurs using T units, the indices w and y are equal to 1 and x is equal to 0.

An preferred embodiment of the present invention which comprises PA units, T units, and L units includes the reaction product of:

a) 1 part by weight, of a polyamine obtained by condensation of 1 mole of a dicarboxylic acid with a polyalkylene polyamine (i.e., diethylenetriamine) to the extent wherein at least about 10% of the —NH backbone hydrogens are unmodified by reaction with said dicarboxylic acid, then optionally reacting the obtained polyamine condensation product with up to 8 ethyleneimine units (i.e., grafting of the backbone using aziridine) per basic nitrogen atom; and b) further reacting the product obtained in (a) with from 0.3 to 2 parts by weight, of an L units, inter alia the reaction product of a polyalkylene oxide having from 8 to 100 alkylene oxide units with epichlorohydrin at a temperature of form about 20° C. to about 100° C.

A preferred embodiment of the present invention are the water-soluble condensation products which can be obtained by the reaction of:

a) polyalkyleneimines and polyalkyleneimines grafted with ethyleneimines, and mixtures thereof; with b) at least bifunctional halogen-free cross-linking agents, said agents selected from the group consisting of:

i) ethylene carbonate, propylene carbonate, urea, and mixtures thereof;

ii) mono-carboxylic acids comprising one olefin moiety inter alia acrylic acid, methacrylic acid, crotonic acid; and the esters, amides, and anhydrides thereof; polycarboxylic acids inter alia oxalic acid, succinic acid, tartaric acid, itaconic acid, maleic acid; and the esters, amides, and anhydrides thereof;

iii) reaction products of polyetherdiamines, alkylenediamines, polyalkylenediamines, and mixtures thereof, with mono-carboxylic acids comprising one olefin moiety wherein the resulting polyamine comprises a functional units which is selected from the group consisting of at least two ethylenically unsaturated double bonds, carbonamide, carboxyl group, ester group, and mixtures thereof;

iv) at least two aziridine group-containing reaction products of dicarboxylic acid esters with ethyleneimine and mixtures of the cross-linking agents.

However, prior to reaction of $(PA)_w(T)_x$ units formed herein above, the $(PA)_w(T)_x$ polyamine compound may be partially amidated ("capped" as described herein above) by treatment with a mono carboxylic acid or the esters of mono carboxylic acids. The formulator may vary the degree to which the backbone nitrogens are amidated according to the desired properties of the final Fabric Enhancement Polymer. Non-limiting examples of suitable mono-carboxylic acids include formic acid, acetic acid, propionic acid, benzoic acid, salicylic acid, lauric acid, palmitic acid, stearic acid, oleic acid, linoleic acid, behenic acid, and mixtures thereof.

The high molecular weight modified polyamine condensation products of the present invention (also referred to herein as "resins") are preferably formed from the reaction of one or more grafted, cross-linked polyethyleneimines and one or more polyethylene and/or polypropylene glycol copolymers, wherein the resulting crosslinked modified polyamines (resins) have a final viscosity of more than or equal to 300 mPa-sec., preferably from 400 to 2,500 mPa-sec. when measured at 20° C. in a 20% aqueous solution. The modified polyamine compounds of the present invention are suitably described in U.S. Pat. No. 3,642,572 Eadres et al., issued Feb. 15, 1972, U.S. Pat. No. 4,144,123 Scharf et al., issued Mar. 13, 1979 and U.S. Pat. No. 4,371,674 Hertel et al., issued Feb. 1, 1983, NE 6,612,293, DT 1,946,471, DT 36386, DT 733,973, DE 1,771,814, all of which are included herein by reference.

Transition Metal-Comprising Dye Protection System

The transition metal-comprising dye protection system of the present invention prevents the loss of color from fabric due to the chelation of heavy metal ions which comprise fabric dyes by laundry composition ingredients. The fabric care and laundry detergent compositions of the present invention comprise from about 0.01%, preferably from about 0.1%, more preferably from 0.25%, most preferably from about 0.5% to about 20%, preferably to about 10%, more preferably to about 5% by weight, of a transition metal-comprising dye protection system.

The transition metal-comprising dye protection agents are preferably oligomers which are formed from the reaction of one or more substituted of unsubstituted polymerizable imidazoles with an epihalohydrin crosslinking agent, preferably epichlorohydrin.

The oligomers are preferably formed from the reaction of:

i) 1 part by weight of an epihalohydrin; and ii) from 0.5, preferably from 0.75, more preferably from 1 to 2, preferably to about 1.7 parts by weight, of a substituted or unsubstituted imidazole. Most preferred is 1.4 parts by weight, of a substituted or unsubstituted imidazole.

For the purposes of the present invention the term "substituted imidazole" is defined as "an imidazole which has the hydrogen atom at the number 2-carbon atom substituted by a $C_1$–$C_{18}$ alkyl unit". The imidazoles suitable for use in forming the oligomers of the present invention have the formula:

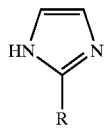

wherein R is hydrogen, $C_1$–$C_{18}$ alkyl, and mixtures thereof; preferably hydrogen or $C_1$–$C_8$ alkyl; more preferably hydrogen or $C_1$–$C_4$ alkyl, most preferably hydrogen. The imidazoles may be as the free compounds or the salts thereof.

Once formed, the oligomers have the formula:

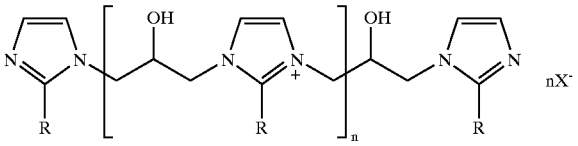

wherein R is defined herein above and X is a water soluble cation, preferably X is derived from the leaving group of the epihalohydrin, inter alia, chlorine.

A further example of materials suitable for use in the transition metal-comprising dye protection system of the present invention are gallic acid comprising resins, for example, gallate ester resins derived from reducing or non-reducing sugars, inter alia, tannic acid. However, tannins derived from flavanol resins, are also as suitable for use as transition metal-comprising dye protection agents.

Fabric Care Compositions

The fabric care compositions of the present invention comprise:

a) from about 0.01% by weight, of a fabric enhancement system, said fabric enhancement system comprising one or more modified polyamine compounds, said modified polyamine compounds are selected from:
   i) $(PA)_w(T)_x$;
   ii) $(PA)_w(L)_z$;
   iii) $[(PA)_w(T)_x]_y[L]_z$; and
   iv) mixtures thereof;
   wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

b) from about 0.01% by weight, of a transition metal-comprising dye protection system, said dye protection system comprising one or more oligomers formed from the reaction of:
   i) 1 part by weight of an epihalohydrin; and
   ii) from 0.5 to 2 parts by weight of a substituted or unsubstituted imidazole c) optionally from about 1%, preferably from about 10%, more preferably from about 20% to about 80%, preferably to about 60%, more preferably to about 45% by weight, of a fabric softening active;

d) optionally less than about 15% by weight, of a principal solvent, preferably said principal solvent has a ClogP of from about 0.15 to about 1;

e) optionally from about 0.001% to about 90% by weight, of one or more dye fixing agents;

f) optionally from about 0.01% to about 50% by weight, of one or more cellulose reactive dye fixing agents;

g) optionally from about 0.01% to about 15% by weight, of a chlorine scavenger;

h) optionally about 0.005% to about 1% by weight, of one or more crystal growth inhibitors;

i) optionally from about 0.01% to about 20% by weight, of a fabric abrasion reducing polymer;

j) optionally from about 1% to about 12% by weight, of one or more liquid carriers;

k) optionally from about 0.001% to about 1% by weight, of an enzyme;

l) optionally from about 0.01% to about 8% by weight, of a polyolefin emulsion or suspension;

m) optionally from about 0.01% to about 0.2% by weight, of a stabilizer;

n) optionally from about 1% to about 80% by weight, of a fabric softening active;

o) optionally from about 0.5% to about 10% by weight, of a cationic nitrogen compound; and p) the balance carrier and adjunct ingredients.

Laundry Detergent Compositions

The laundry detergent compositions of the present invention take the form which comprises:

a) from about 0.01% by weight, of a fabric enhancement system, said fabric enhancement system comprising one or more modified polyamine compounds, said modified polyamine compounds are selected from:
i) $(PA)_w(T)_x$;
ii) $(PA)_w(L)_z$;
iii) $[(PA)_w(T)_x]_y[L]_z$; and
iv) mixtures thereof;
wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05, preferably from about 0.3 to 2 parts by weight of said L unit; for compounds of type (iii) the indices y and z have values such that said modified polyamine compound comprises from about 0.05, preferably from about 0.3 to 2 parts by weight of said L unit;

b) from about 0.01% by weight, of a detersive surfactant selected from the group consisting of anionic, cationic, nonionic, zwitterionic, ampholytic surfactants, and mixtures thereof; and c) the balance carriers and adjunct ingredients, wherein said adjunct ingredients are selected from the group consisting of builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti-corrosion agents, and mixtures thereof.

Surfactant System

The laundry detergent compositions of the present invention may comprise at least about 0.01% by weight, preferably from about 0.1% to about 60%, preferably to about 30% by weight, of a detersive surfactant system, said system is comprised of one or more category of surfactants depending upon the embodiment, said categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having the formula:

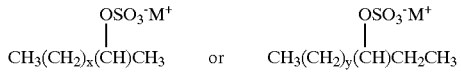

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates ($AE_xS$) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

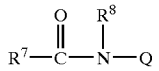

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_nCH_2OH$, $—CH(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

The laundry detergent compositions of the present invention can also comprise from about 0.001% to about 100% of one or more (preferably a mixture of two or more) mid-chain branched surfactants, preferably mid-chain branched alkyl alkoxy alcohols having the formula:

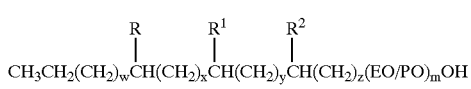

mid-chain branched alkyl sulfates having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zOSO_3M$$

and mid-chain branched alkyl alkoxy sulfates having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_z(EO/PO)_mOSO_3M$$

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w+x+y+z is from 8 to 14. EO and PO represent ethyleneoxy units and propyleneoxy units having the formula:

$$-\overset{\overset{\displaystyle CH_3}{|}}{C}HCH_2O- \quad \text{or} \quad -CH_2\overset{\overset{\displaystyle CH_3}{|}}{C}HO-$$

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

$$CH_3(CH_2)_a\overset{\overset{\displaystyle CH_3}{|}}{C}H(CH_2)_bCH_2(EO/PO)_mOSO_3M$$

or the formula:

$$CH_3(CH_2)_d\overset{\overset{\displaystyle CH_3}{|}}{C}H(CH_2)_e\overset{\overset{\displaystyle CH_3}{|}}{C}HCH_2(EO/PO)_mOSO_3M$$

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants.

The surfactant systems of the laundry detergent compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) mid-chain branched alkyl arylsulfonate surfactants, preferably surfactants wherein the aryl unit is a benzene ring having the formula:

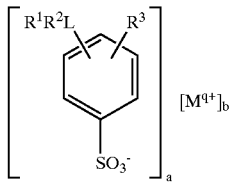

wherein L is an acyclic hydrocarbyl moiety comprising from 6 to 18 carbon atoms; $R^1$, $R^2$, and $R^3$ are each independently hydrogen or $C_1$–$C_3$ alkyl, provided $R^1$ and $R^2$ are not attached at the terminus of the L unit; M is a water soluble cation having charge q wherein a and b are taken together to satisfy charge neutrality.

Adjunct Ingredients

The following are non-limiting examples of adjunct ingredients useful in the laundry compositions of the present invention, said adjunct ingredients include cationic nitrogen compounds, builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, antioxidants, chelants, stabilizers, anti-shrinkage agents, anti-wrinkle agents, germicides, fungicides, anti corrosion agents, and mixtures thereof.

Cationic Nitrogen Compounds—The fabric enhancement compositions of the present invention may optionally comprise from about 0.5%, preferably from about 1% to about 10%, preferably to about 5% by weight, of one or more cationic nitrogen containing compound, preferably a cationic compound having the formula:

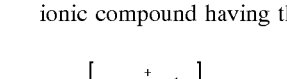

wherein R is $C_{10}$–$C_{18}$ alkyl, each $R^1$ is independently $C_1$–$C_4$ alkyl, X is a water soluble anion; preferably R is $C_{12}$–$C_{14}$, preferably $R^1$ is methyl. Preferred X is halogen, more preferably chlorine. Examples of cationic nitrogen compounds suitable for use in the fabric care compositions of the present invention are Non-limiting examples of preferred cationic nitrogen compounds are N,N-dimethyl-(2-hydroxyethyl)-N-dodecyl ammonium bromide, N,N-dimethyl-(2-hydroxyethyl)-N-tetradecyl ammonium bromide. Suitable cationic nitrogen compounds are available ex Akzo under the tradenames Ethomeen T/15®, Secominc TA15®, and Ethoduomeen T/20®.

Builders—The laundry detergent compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923, 679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111,984 Gosselink, published Jun. 27, 1984; European Patent Application 112,592 Gosselink, published Jul. 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylaies and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occurring subsequent to treatment with the soil release agent to be more easily cleaned in later washing procedures.

The following, all included herein by reference, describe soil release polymers suitable for use in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al, issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N. V., 1974; all incorporated herein by reference.

As a non-limiting example, granular compositions are generally made by combining base granule ingredients, e.g., surfactants, builders, water, etc., as a slurry, and spray drying the resulting slurry to a low level of residual moisture (5–12%). The remaining dry ingredients, e.g., granules of the polyalcyleneimine dispersant, can be admixed in granular powder form with the spray dried granules in a rotary mixing drum. The liquid ingredients, e.g., solutions of the polyalkyleneimine dispersant, enzymes, binders and perfumes, can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents. Addition of the polyalkyleneimine dispersant to liquid detergent or other aqueous compositions of this invention may be accomplished by simply mixing into the liquid solutions the polyalkyleneimine dispersant.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

Method of Use

The present invention further relates to a method for providing protection and enhancement of fabric, said method comprising the step of contacting a fabric with an aqueous solution containing a least 50 ppm, preferably at least about 100 ppm, more preferably at least about 200 ppm, of a fabric care composition which comprises:

a) from about 0.01% by weight, of a fabric enhancement system, said fabric enhancement system comprising one or more modified polyamine compounds, said modified polyamine compounds are selected from:
   i) $(PA)_w(T)_x$;
   ii) $(PA)_w(L)_z$;
   iii) $[(PA)_w(T)_x]_y[L]_z$; and
   iv) mixtures thereof;
   wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05, preferably from about 0.3 to 2 parts by weight of said L unit; for compounds of type (iii) the indices y and z have values such that said modified polyamine compound comprises from about 0.05, preferably from about 0.3 to 2 parts by weight of said L unit;

b) from about 0.01% by weight, of a transition metal-comprising dye protection system, said dye protection system comprising one or more oligomers formed from the reaction of:
   i) 1 part by weight of an epihalohydrin; and
   ii) from 0.5 to 2 parts by weight of a substituted or unsubstituted imidazole; and c) the balance carriers and adjunct ingredients.

Preferably the method of the present invention relates to a method for providing protection and enhancement of fabric, said method comprising the step of contacting a fabric with an aqueous solution containing a least 50 ppm, preferably at least about 100 ppm, more preferably at least about 200 ppm, of a fabric care composition which comprises:

a) from about 0.01% by weight, of a fabric enhancement system, said fabric enhancement system comprising one or more modified polyamine compounds, said modified polyamine compounds are selected from:
   i) $(PA)_w(T)_x$;
   ii) $(PA)_w(L)_z$;
   iii) $[(PA)_w(T)_x]_y[L]_z$; and
   iv) mixtures thereof;
   wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

b) from about 0.01% by weight, of a transition metal-comprising dye protection system, said dye protection system comprising one or more oligomers formed from the reaction of:
   i) 1 part by weight of an epihalohydrin; and
   ii) from 0.5 to 2 parts by weight of a substituted or unsubstituted imidazole c) optionally from about 1%, preferably from about 10%, more preferably from about 20% to about 80%, preferably to about 60%, more preferably to about 45% by weight, of a fabric softening active;

d) optionally less than about 15% by weight, of a principal solvent, preferably said principal solvent has a ClogP of from about 0.15 to about 1;

e) optionally from about 0.001% to about 90% by weight, of one or more dye fixing agents;

f) optionally from about 0.01% to about 50% by weight, of one or more cellulose reactive dye fixing agents;

g) optionally from about 0.01% to about 15% by weight, of a chlorine scavenger;

h) optionally about 0.005% to about 1% by weight, of one or more crystal growth inhibitors;

i) optionally from about 0.01% to about 20% by weight, of a fabric abrasion reducing polymer;

j) optionally from about 1% to about 12% by weight, of one or more liquid carriers;

k) optionally from about 0.001% to about 1% by weight, of an enzyme;

l) optionally from about 0.01% to about 8% by weight, of a polyolefin emulsion or suspension;

m) optionally from about 0.01% to about 0.2% by weight, of a stabilizer;

n) optionally from about 1% to about 80% by weight, of a fabric softening active;

o) optionally from about 0.5% to about 10% by weight, of a cationic nitrogen compound; and p) the balance carrier and adjunct ingredients.

The fabric care compositions according to the present invention can be in liquid, paste, laundry bar, or granular form. Such compositions can be prepared by combining the essential and optional components in the requisite concentrations in any suitable order and by any conventional means.

The following are examples of fabric care compositions which comprise a fabric enhancement system of the present invention.

TABLE I

| Ingredients | weight % 1 | 2 | 3 |
|---|---|---|---|
| Dye fixative[1] | 5.0 | 2.4 | 2.4 |
| Bayhibit AM[2] | 1.0 | 1.0 | 1.0 |
| $C_{12}$ Trimethyl ammonium chloride | 2.0 | 2.0 | 2.0 |
| Fabric enhancement polyamine[3] | 3.0 | 3.0 | 3.0 |
| Fabric enhancement polyamine[4] | 3.5 | 3.5 | 3.5 |
| Heavy metal dye transfer inhibitor[5] | 3.0 | 3.0 | 1.0 |
| Water and minors[6] | balance | balance | balance |

[1]Dye fixing agent ex Clariant under the tradename Cartafix CB ®.
[2]2-Phosphonobutane-1,2,4-tricarboxylic acid ex Bayer.
[3]Lupasol ® SKA ex BASF.
[4]Luviskol ® K85 ex BASF.
[5]Oligomeric polyamine formed from the condensation of 1 part epichlorohydrin and 1.4 parts imidazole and comprising about 94% oligomer and about 6% imidazole, said oligomer having an average molecular weight of about 2000 daltons.
[6]All formulations have a pH of from 5 to 5.5 and a viscosity of 100–180 cps.

TABLE II

| Ingredients | weight % 4 | 5 | 6 |
|---|---|---|---|
| Dye fixative[1] | 2.4 | 4.0 | 5.0 |
| Bayhibit AM[2] | 0.5 | 1.0 | 0.5 |
| $C_{12}$ Trimethyl ammonium chloride | 2.0 | 3.0 | 5.0 |
| Fabric enhancement polyamine[3] | 1.0 | 3.0 | 5.0 |
| Fabric enhancement polyamine[4] | 3.5 | 4.0 | 6.0 |
| Heavy metal dye transfer inhibitor[5] | 0.1 | 3.0 | 2.0 |
| Water and minors[6] | balance | balance | balance |

[1]Dye fixing agent ex Clariant under the tradename Cartafix CB ®.
[2]2-Phosphonobutane-1,2,4-tricarboxylic acid ex Bayer.
[3]Lupasol ® SKA ex BASF.
[4]Luviskol ® K85 ex BASF.
[5]Oligomeric polyamine formed from the condensation of 1 part epichlorohydrin and 1.4 parts imidazole and comprising about 94% oligomer and about 6% imidazole, said oligomer having an average molecular weight of about 2000 daltons.
[6]All formulations have a pH of from 5 to 5.5 and a viscosity of 100–180 cps.

TABLE III

| Ingredients | weight % 7 | 8 | 9 | 10 |
|---|---|---|---|---|
| Polyhydroxy coco-fatty acid amide | 2.50 | 4.00 | 4.50 | — |
| NEODOL 24-7[1] | — | 4.50 | — | — |
| NEODOL 23-9[2] | 0.63 | — | 4.50 | 2.00 |
| $C_{25}$ Alkyl ethoxylate sulphate | 20.15 | 4.00 | 5.50 | 20.50 |
| $C_{25}$ Alkyl sulfate | — | 14.00 | 15.00 | — |
| C11.8 linear alkylbenzene sulfonate | — | — | — | 6.00 |
| $C_{8-10}$-Amidopropyl Amine | — | 1.30 | — | — |
| $C_{10}$-Amidopropyl Amine | 0.50 | — | — | 1.50 |
| Citric acid | 3.00 | 2.00 | 3.00 | 2.50 |
| C12–18 fatty acid | 2.00 | 6.50 | 5.00 | 5.00 |
| Rapeseed fatty acid | — | 4.10 | — | 6.50 |
| Ethanol | 3.36 | 1.53 | 5.60 | 0.50 |
| Propanediol | 7.40 | 9.20 | 6.22 | 4.00 |
| Monoethanolamine | 1.00 | 7.90 | 8.68 | 0.50 |
| Sodium hydroxide | 2.75 | 1.30 | 0.75 | 4.40 |
| Sodium p-toluene sulfonate | 2.25 | — | 1.90 | — |
| Borax/Boric acid | 2.50 | 2.00 | 3.50 | 2.50 |
| Protease[3] | 0.88 | 0.74 | 1.50 | 0.88 |

TABLE III-continued

| Ingredients | weight % | | | |
|---|---|---|---|---|
| | 7 | 8 | 9 | 10 |
| Lipolase[4] | — | 0.12 | 0.18 | — |
| Duramyl[5] | 0.15 | 0.11 | — | 0.15 |
| CAREZYME | 0.053 | 0.028 | 0.080 | 0.053 |
| Dispersant[6] | 0.60 | 0.70 | 1.50 | 0.60 |
| Ethoxylated polyalkyleneimine[7] | 1.20 | 0.70 | 1.50 | 1.20 |
| Optical Brightener | 0.13 | 0.15 | 0.30 | 0.15 |
| Fabric enhancement polyamine[8] | 5.00 | 1.00 | — | — |
| Fabric enhancement polyamine[9] | — | — | 0.25 | 0.50 |
| Dye protection system[10] | 0.75 | 0.25 | 1.00 | 0.75 |
| Suds suppresser | 0.12 | 0.28 | 0.12 | 0.12 |
| Minors, aesthetics, stablizers, water | balance | balance | balance | balance |

[1]$C_{12}$–$C_{14}$ alkyl ethoxylate as sold by Shell Oil Co.
[2]$C_{12}$–$C_{13}$ alkyl ethoxylate as sold by Shell Oil Co.
[3]Protease B variant of BPN' wherein Tyr 17 is replaced with Leu.
[4]Derived from *Humicola lanuginosa* and commercially available from Novo.
[5]Disclosed in WO 9510603 A and available from Novo.
[6]Hydrophilic dispersant PEI 189 $E_{15}$–$E_{18}$ according to U.S. Pat. 4,597,898, Vander Meer, issued Jul. 1, 1986.
[7]Polyalkyleneimine dispersant PEI 600 $E_{20}$.
[8]Lupasol ® SK ex BASF.
[9]Lupasol ® SKA ex BASF.
[10]Oligomeric polyamine formed from the condensation of 1 part epichlorohydrin and 1.4 parts imidazole and comprising about 94% oligomer and about 6% imidazole, said oligomer having an average molecular weight of about 2000 daltons.

What is claimed is:

1. A fabric care composition comprising:

a) at least 0.01% by weight, of a fabric enhancement system, said fabric enhancement system comprising one or more modified polyamine compounds, said modified polyamine compounds are selected from:
i) $(PA)_w(T)_x$;
ii) $(PA)_w(L)_z$;
iii) $[(PA)_w(T)_x]_y[L]_z$; and
iv) mixtures thereof;
wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

b) at least 0.01% by weight, of a transition metal-comprising dye protection system, said dye protection system comprising one or more oligomers formed from the reaction of:
i) 1 part by weight of an epihalohydrin; and
ii) from 1 to 2 parts by weight of a substituted or unsubstituted imidazole; and c) the balance carriers and adjunct ingredients.

2. A composition according to claim 1 wherein said transition metal-comprising dye protection system comprises an admixture of one or more oligomers having the formula:

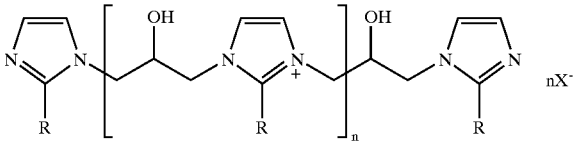

wherein R is hydrogen, $C_1$–$C_{18}$ alkyl, and mixtures thereof; X is a water soluble anion; the index n has a value such that the average molecular of said oligomer admixture is from about 500 daltons to about 5000 daltons.

3. A composition according to claim 2 wherein R is hydrogen.

4. A composition according to claim 1 wherein said transition metal-comprising dye protection system comprises an admixture of one or more oligomers having the formula:

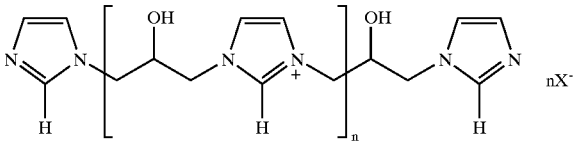

wherein X is a hydrogen selected from the group consisting of chlorine, bromine, iodine, and mixtures thereof; the index n is from about 10 to about 20.

5. A composition according to claim 4 wherein n is from 13 to about 17.

6. A composition according to claim 1 wherein said dye protection system comprises one or more oligomers formed from the reaction of:

i) 1 part by weight of an epihalohydrin; and
ii) from 1 to 1.7 parts by weight of a substituted or unsubstituted imidazole.

7. A composition according to claim 6 wherein said oligomer is formed from the reaction of:

i) 1 part by weight of an epihalohydrin; and
ii) at least 1.4 parts by weight of a substituted or unsubstituted imidazole.

8. A composition according to claim 7 wherein said oligomer is formed from the reaction of:

i) 1 part by weight of an epihalohydrin; and
ii) at least 1.4 parts by weight of imidazole.

9. A composition according to claim 1 wherein said oligomer has a molecular weight of from about 500 about 5000 daltons.

10. A composition according to claim 1 wherein said oligomer is formed from the reaction of:

i) 1 part by weight of an epihalohydrin; and
ii) at least 1.4 parts by weight of imidazole
wherein said oligomer has an average molecular weight of from about 1800 to about 2200 daltons.

11. A composition according to claim 1 wherein said PA polyamine backbone unit comprises a polyamine which is grafted wherein said grafting agent is selected from aziridine, caprolactam, and mixtures thereof.

12. A composition according to claim 1 wherein said T unit has the formula:

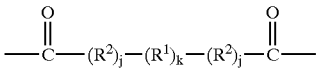

wherein $R^1$ is methylene, phenylene, and mixtures thereof; $R^2$ is —NH—; k is from 2 to 8, each j is independently 0 or 1.

13. A composition according to claim 1 wherein said L unit is selected from:

i) polyalkylene units having the formula:

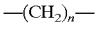

wherein n is from 1 to about 50;

ii) epihalohydrin/polyalkylene units having the formula:

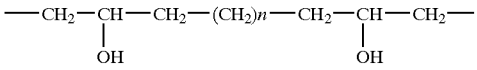

wherein n is from 1 to 50;

iii) polyalkyleneoxy comprising units having the formula:

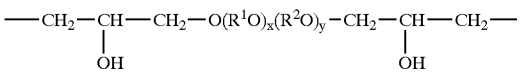

wherein $R^1$ is ethylene, $R^2$ is 1,2-propylene, x is from 0 to 100 and y is from 0 to 100;

iv) polyhydroxy comprising units having the formula:

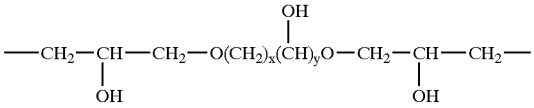

wherein the index t is at least 2 and the index u is from 1 to about 6;

v) polyalkyleneoxy/polyhydroxy comprising units having the formula:

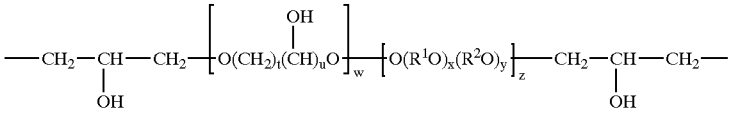

wherein $R^1$, $R^2$, t, u, x, and y are the same as defined above, the indexes w and z are each independently from 1 to 50;

vi) units which comprise an aziridine unit having the formula:

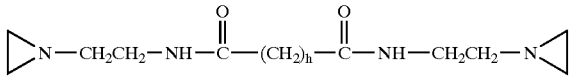

wherein h is from 0 to 22; and vii) mixtures thereof.

14. A composition according to claim 1 wherein said fabric enhancement polyamine compound is formed by the reaction of:

a) 1 part by weight, of a polyamidoamine obtained by condensation of 1 mole of a dicarboxylic acid with from 0.8 to 1.5 moles of a polyalkylene polyamine then optionally reacting the obtained polyamidoamine condensation product with up to 8 ethyleneimine units per basic nitrogen atom; and b) further reacting the product obtained in (a) with from 0.05 to 2 parts by weight, of a reaction product of a polyalkylene oxide having from 8 to 100 alkylene oxide units with epichlorohydrin at a temperature of from about 20° C. to about 100° C.

15. A fabric care composition comprising:

a) at least 0,01% by weight, of a fabric enhancement system, said fabric enhancement system comprising one or more modified polyamine compounds, said modified polyamine compounds are selected from:

i) $(PA)_w(T)_x$;

ii) $(PA)_w(L)_z$;

iii) $[(PA)_w(T)_x]_y[L]_z$; and iv) mixtures thereof;

wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

b) at least 0.01% by weight, of a transition metal-comprising dye protection system, said dye protection system comprising one or more oligomers formed from the reaction of:

i) 1 part by weight of an epihalohydrin; and ii) from 1 to 2 parts by weight of a substituted or unsubstituted imidazole c) optionally at least about 1%, by weight, of a fabric softening active;

d) optionally less than about 15% by weight, of a principal solvent;

e) optionally from about 0.001% to about 90% by weight, of one or more dye fixing agents;

f) optionally from about 0.01% to about 50% by weight, of one or more cellulose reactive dye fixing agents;

g) optionally from about 0.01% to about 15% by weight, of a chlorine scavenger;

h) optionally about 0.005% to about 1% by weight, of one or more crystal growth inhibitors;

i) optionally from about 0.01% to about 20% by weight, of a fabric abrasion reducing polymer;

j) optionally from about 1% to about 12% by weight, of one or more liquid carriers;

k) optionally from about 0.001% to about 1% by weight, of an enzyme;

l) optionally from about 0.01% to about 8% by weight, of a polyolefin emulsion or suspension;

m) optionally from about 0.01% to about 0.2% by weight, of a stabilizer;

n) optionally from about 1% to about 80% by weight, of a fabric softening active;

o) optionally from about 0.5% to about 10% by weight, of a cationic nitrogen compound; and p) the balance carrier and adjunct ingredients.

16. A composition according to claim 15 wherein said dye protection system comprises one or more oligomers formed from the reaction of:

i) 1 part by weight of an epihalohydrin; and ii) at least 1.4 parts by weight of imidazole.

17. A laundry detergent composition comprising:

a) at least 0.01% by weight, of a detersive surfactant selected from the group consisting of anionic, cationic, nonionic, zwitterionic, ampholytic surfactants, and mixtures thereof;

b) at least 0.01% by weight, of a fabric enhancement system, said fabric enhancement system comprising one or more modified polyamine compounds, said modified polyamine compounds are selected from:

i) $(PA)_w(T)_x$;

ii) $(PA)_w(L)_z$;

iii) $[(PA)_w(T)_x]_y[L]_z$; and iv) mixtures thereof;

wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

c) at least 0.01% by weight, of a transition metal-comprising dye protection system, said dye protection system comprising one or more oligomers formed from the reaction of:

i) 1 part by weight of an epihalohydrin; and ii) from 1 to 2 parts by weight of a substituted or unsubstituted imidazole; and d) the balance carriers and adjunct ingredients.

18. A composition according to claim 17 wherein said adjunct ingredients are selected from the group consisting of builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

19. A composition according to claim 17 wherein said transition metal-comprising dye protection system comprises an admixture of one or more oligomers having the formula:

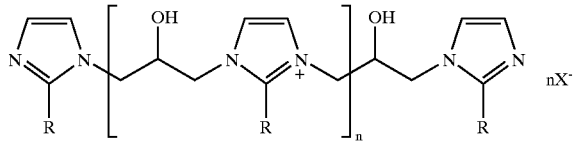

wherein R is hydrogen, $C_1$–$C_{18}$ alkyl, and mixtures thereof; X is a water soluble anion; the index n has a value such that the average molecular of said oligomer admixture is from about 500 daltons to about 5000 daltons.

20. A method for preventing fading of dye from fabric comprising the step on contacting fabric with an aqueous solution containing at least 50 ppm of a laundry detergent composition which comprises:

a) at least 0.01% by weight, of a detersive surfactant selected from the group consisting of anionic, cationic, nonionic, zwitterionic, ampholytic surfactants, and mixtures thereof;

b) at least 0.01% by weight, of a fabric enhancement system, said fabric enhancement system comprising one or more modified polyamine compounds, said modified polyamine compounds are selected from:

i) $(PA)_w(T)_x$;

ii) $(PA)_w(L)_z$;

iii) $[(PA)_w(T)_x]_y[L]_z$; and iv) mixtures thereof;

wherein PA is a grafted or non-grafted, modified or unmodified polyamine backbone unit, T is an amide-forming polycarboxylic acid crosslinking unit, and L is a non-amide forming crosslinking unit; provided that for compounds of type (i) and (iii) the indices w and x have values such that the ratio of w to x is from 0.8:1 to 1.5:1; for compounds of type (ii) the indices w and z have values such that said modified polyamine compound comprises from about 0.05 to about 2 parts by weight of said L unit; for compounds of type (iii) the indices y and z have values such that said modified polyamine compound comprises from about 0.05 to about 2 parts by weight of said L unit;

c) at least 0.01% by weight, of a transition metal-comprising dye protection system, said dye protection system comprising one or more oligomers formed from the reaction of:

i) 1 part by weight of an epihalohydrin; and ii) from 1 to 2 parts by weight of a substituted or unsubstituted imidazole; and d) the balance carriers and adjunct ingredients, said adjunct ingredients are selected from the group consisting of builders, optical brighteners, soil release polymers, dye transfer agents, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti corrosion agents, and mixtures thereof.

* * * * *